US007156791B2

(12) United States Patent
Edwards

(10) Patent No.: US 7,156,791 B2
(45) Date of Patent: Jan. 2, 2007

(54) YOGA GRIP BLOCK

(76) Inventor: Richard Edwards, 7825 Michigan Ave., Oakland, CA (US) 94605

( * ) Notice: Subject to any disclaimer, the term of this patent is extended or adjusted under 35 U.S.C. 154(b) by 613 days.

(21) Appl. No.: 10/126,006

(22) Filed: Apr. 19, 2002

(65) Prior Publication Data

US 2003/0199375 A1 Oct. 23, 2003

(51) Int. Cl.
*A63B 71/00* (2006.01)

(52) U.S. Cl. ..... 482/148; 446/120; 446/476

(58) Field of Classification Search ..... 482/148, 482/141, 91, 25, 104–108, 51; 15/234.6, 15/234.8, 234.5, 234.4; 248/148, 51, 52, 248/49; 446/120–121, 124–125, 476; 37/461, 37/182; 43/5; 56/400.12; 294/85, 26; D21/398
See application file for complete search history.

(56) References Cited

U.S. PATENT DOCUMENTS 3,115,338 A 12/1963 Acs
3,238,662 A * 3/1966 Van Riper et al. ..... 46/33
3,239,662 A * 3/1966 Riper et al. ..... 446/141
3,884,464 A * 5/1975 Evangelos ..... 272/79 R
4,327,907 A 5/1982 DeVries
4,691,828 A * 9/1987 Slusarczyk et al. ..... 206/509
4,712,794 A * 12/1987 Hall ..... 482/74
4,854,573 A 8/1989 Johannson
5,466,206 A * 11/1995 Fleming ..... 482/141
5,702,330 A * 12/1997 De Monbrun et al. ..... 482/105
6,055,769 A * 5/2000 Ray ..... 47/41.12
6,179,682 B1 * 1/2001 Plain et al. ..... 446/141
6,224,517 B1 * 5/2001 Dereszynski ..... 482/93
6,461,282 B1 * 10/2002 Fenelon ..... 482/106
6,641,452 B1 * 11/2003 Racine ..... 446/122
6,730,004 B1 * 5/2004 Selsam ..... 482/93
2002/0177509 A1 * 11/2002 Rodgers et al. ..... 482/53

* cited by examiner

*Primary Examiner*—Lori Amerson
(74) *Attorney, Agent, or Firm*—Gary Baker; Quine Intellectual Property Law Group, P.C.

(57) ABSTRACT

Yoga grip blocks having one or more block sections and a grip section that provide support and comfort in the practice of yoga exercises. The invention includes preferred materials to fabricate yoga grip blocks and describes methods of using yoga grip blocks.

12 Claims, 2 Drawing Sheets

YOGA GRIP BLOCK

REFERENCES CITED

| | |
|---|---|
| Title: | Yoga Grip Block |
| Inventor: | Richard Edwards<br>7825 Michigan Avenue<br>Oakland, CA 94605 |
| Attorney: | Gary Baker<br>PTO Reg. #41,595<br>1563 Boxwood Avenue<br>San Leandro, CA 94579-1303<br>(510) 483-8220 |

| | | References Cited<br>U.S. PATENT DOCUMENTS |
|---|---|---|
| 3,115338 | Dec. 24, 1963 | U.S. Pat. No. |
| 3,884,464 | May 20, 1975 | U.S. Pat. No. |
| 4,327907 | May 4, 1982 | U.S. Pat. No. |
| 4,854,573 | Aug. 8, 1989 | U.S. Pat. No. |
| 5,466,206 | Nov. 14, 1995 | U.S. Pat. No. |

BACKGROUND OF THE INVENTION

1. Field of the Invention

This invention relates to a class exercise equipment useful for support and a comfortable weight bearing grip in the practice of yoga positions. The invention includes a hand grip connected to one or more block section providing a comfortable hand and wrist orientation for yoga positions requiring hand contact with the floor. The yoga grip blocks can be stacked and provide a support surface for the heels, seat and legs in a variety of yoga positions.

2. Description of Related Art

The practice of yoga generally takes place with a practitioner on a padded floor without any equipment. Many yoga positions require a significant portion of body weight to be supported by the hands of the practitioner on the floor. In such a case, the wrists of the supporting hands are often bent at an extreme angle, the fingers outstretched and flexor tendons under tension. This extreme bending and tension can be uncomfortable or may actually cause trauma to the associated joints, tendons and ligaments. Discomfort and trauma may be accentuated where the practitioner is recuperating from preexisting trauma to the hands or wrist.

Yoga blocks and bricks, currently available on the market, are blocks of hardwood or foam generally about 3"×5"×9". These blocks provide some benefit in support for some positions and allow more comfortable wrist/hand/finger orientations for some positions. For example, current yoga blocks allow the practitioner to reduce the reach to the floor in some positions and to curl the fingers in other positions. Yet, current yoga blocks do not allow a more comfortable wrist position during certain positions where the arms and hands support a large part of the body weight or during the dynamic movements in transitions between some positions.

In the related art of muscle building exercise, similar problems of trauma and discomfort exist. Discomfort and stress to the hands and wrists is common in the well known "push-up" exercise. Many devices exist in the prior art in which a hand grip is attached to a base on the floor allowing the practice of push-ups without stressful wrist angles. Many of such devices are also designed to raise the body to a higher angle and thus reduce the effective weight on the hands during the exercise. However, such devices are not optimal for the practice of yoga exercises.

A typical example of push-up exercise devices is a Portable Exercise Device, hereafter "PED", U.S. Pat. No. 4,327,907. The PED comprises tubular metal pipe bent to a conformation having a handgrip section projecting up from a u-shaped base. Such a design allows push-ups while maintaining a comfortable straight wrist position and a naturally curled finger grip position. In addition, the PED raises the user approximately six inches, changing the inclination of the practitioner's body and lowering the portion of body weight on the hands. These tall PEDs allow muscle builders to do deep push-ups not possible when pushing off the floor.

The PED, and devices like them, are not suitable for the practice of yoga for a variety of reasons. Practitioners can not sit on or stack most PEDs. Most PEDs have grip positions high off the floor so a person doing push-ups can do deep push-ups or so the person be inclined to have less weight supported by the arms. Being more elevated, PEDs can be unstable to lateral forces. PEDs are generally fabricated from wood dowel or tubular steel without grip foam; and do not have a flat upper surface.

OBJECT OF THE INVENTION

Yoga grip blocks of this invention are well suited as a device to aid a practitioner of yoga in a variety of positions. The yoga grip blocks provide an elevated surface to sit on, to prop the heals and to reduce arm reach to the floor. In addition, yoga grip blocks provide a grip section and block contours that allow a choice of wrist, palm and finger orientations while the arms support body weight.

It is the object of this invention to provide a yoga block having one or more flat-topped block sections with an attached grip section. In a preferred embodiment, two block sections are separated by the grip section and the grip section has a flat top surface approximately common to the top surfaces of the block section. Yoga grip blocks are most useful as a pair of blocks, one for each hand and for stacking.

In one aspect of the invention, the height of block sections is less than the width or overall length. It is preferred that a single set of blocks are not more than 5 inches in height, more preferred the blocks are not more than 4 inches in height and most preferred the blocks are less than 3.5 inches in height. In another aspect of the invention, the height of block sections is adjustable.

The yoga grip blocks of the invention can comprise block sections with frictional bottom surfaces and frictional block section top surfaces. The invention further provides a resilient grip section surface.

The yoga grip blocks of the invention can be fabricated from a variety of materials such as hard wood, laminar wood, metal, foam and plastic. Fabrication of the yoga grip blocks is facilitated by forming the block sections and grip section from injection molded plastic.

Another aspect of the invention is a method of using yoga grip blocks comprising operatively positioning one or more yoga grip blocks on a flat surface, practicing yoga positions with the support of the yoga grip blocks or while gripping the yoga grip blocks.

BRIEF DESCRIPTION OF THE DRAWINGS

The invention will now be more particularly described in connection with its preferred embodiments and with reference to the accompanying drawings wherein.

DETAILED DESCRIPTION OF THE INVENTION

Yoga grip blocks of this invention are well suited to the practice of yoga. The yoga grip blocks offer the practitioner of yoga the opportunity to practice more positions, with greater comfort. As a person studies yoga, there are initially many positions they are incapable of practicing due to inadequate support, limited flexibility, poor balance or short reach. Other positions, which require the practitioner to support a large amount of the body weight on the palms of hands with the fingers spread out flat and the wrist bent at nearly a right angle may be difficult for beginners, the elderly or the disabled. The use of yoga grip blocks can aid the entry level and mid level practitioner to achieve positions that otherwise would be unobtainable to them. In addition, the use of yoga grip blocks provides ease, comfort and fluidity of movement to yoga practitioners at every level of experience. The yoga grip blocks of this invention provide support of body weight on palms while fingers are curled and the wrist straight in a neutral position. This neutral wrist position can be useful in prevention of stress injuries and in practicing yoga during convalescence from such injuries. The yoga grip blocks can be stacked for elevated support. Yoga grip blocks have a short, broad profile for stable support against lateral forces and for dynamic movements during yoga exercises.

It is understood that examples and embodiments described herein are for illustrative purposes only and that various modifications or changes in light thereof will be suggested to persons skilled in the art and are to be included within the spirit and purview of this application and scope of the appended claims. All publications, patents, and patent applications cited herein are hereby incorporated by reference in their entirety for all purposes.

Yoga Grip Blocks Generally

Figure 1:
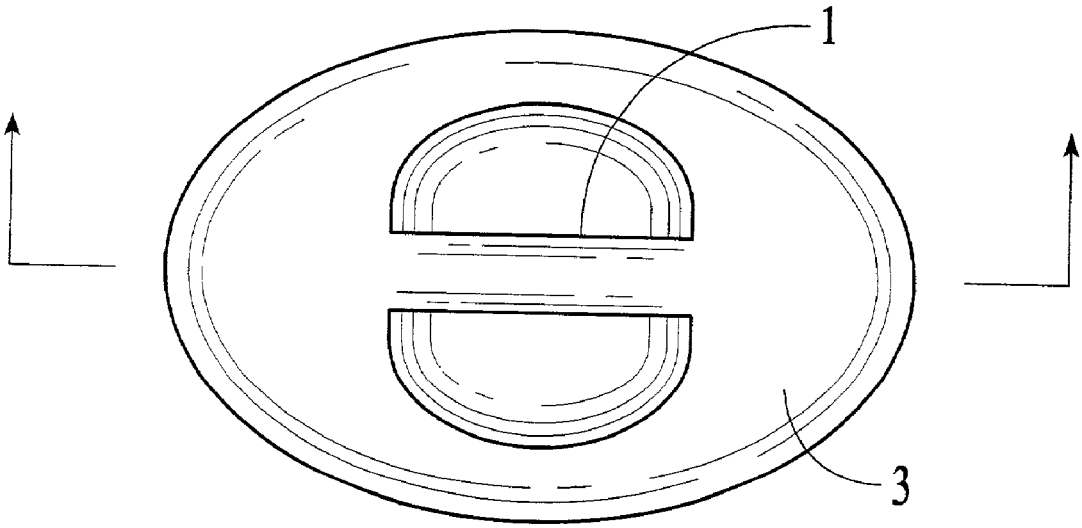
FIG. 1 is a top view of a single yoga grip block section embodiment of the invention.

A yoga grip block of the invention can be a single flat-topped block section attached to a grip section. In a single block section embodiment one configuration of the invention, as shown in top view in FIG. 1 and transverse section in FIG. 2, the grip section 1 spans a concavity of the block section 2 to attach to the block section 2 at opposite sides of the concavity. The top surface 3 of the block section is flat so acts essentially as an elevation of the floor or yoga matt surface.

Figure 3:
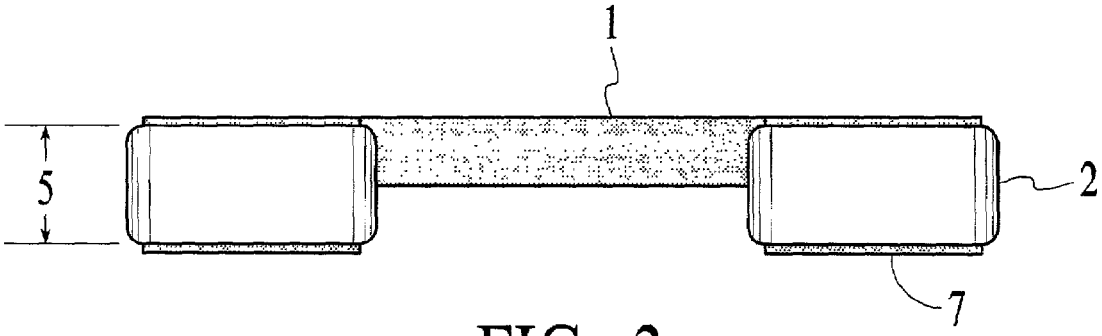
FIG. 3 is a side view of one embodiment of the invention.
Figure 4:
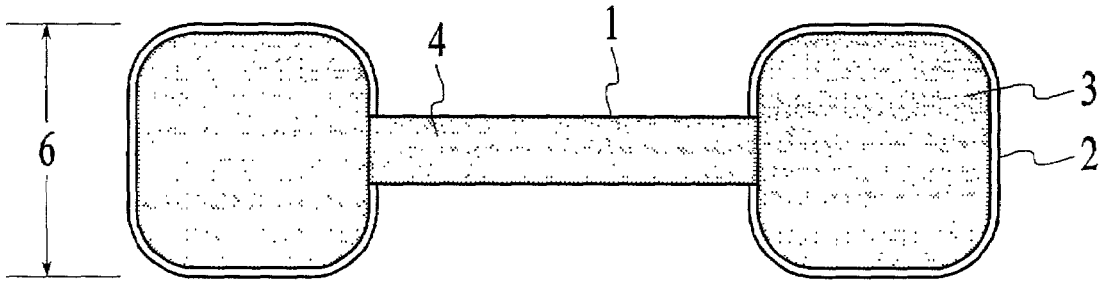
FIG. 4 is a top view of the embodiment if FIG. 3.

Yoga grip blocks of this invention can also be configured as two or more independent block sections separated from each other by a grip section, as shown in side view FIG. 3 and top view FIG. 4. The grip section 1 can be attached to the block sections 2 so that the top surface 4 of the grip section is at approximately the same height as the top surface 3 of the block sections. This configuration, with the top surface 4 of the grip section 1 common to the top surface 3 of the block sections 2 is preferred because it provides a uniform surface for sitting and allows easy stacking. The common top surface configuration described above also has the advantage of allowing short block sections 2 while reserving the most space for gripping and other finger positions between the grip section 1 and a floor surface.

Figure 2:
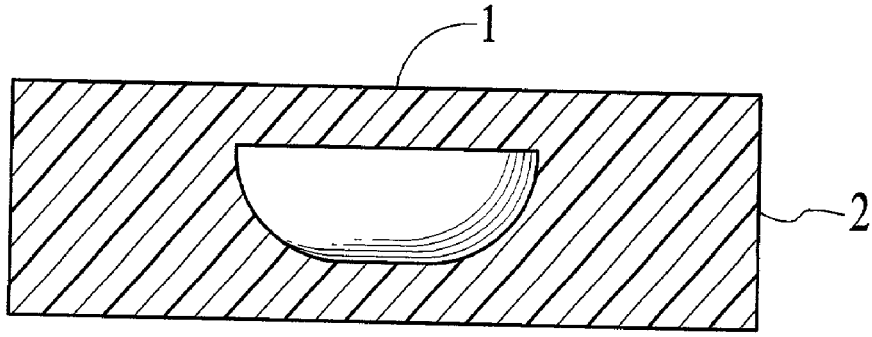
FIG. 2 is a transverse sectional view through the yoga grip block of FIG. 1.

Because a short height and broad base provides a secure foundation against tipping, it is preferred yoga grip blocks of this invention have a height 5 not more than the width 6. In addition, since the yoga grip blocks are stackable, higher support is still available by stacking more than one yoga grip block, if necessary for support of a yoga position. FIG. 2 shows a side view in which the horizontal dimension represents length and the vertical dimension represents the height 5 of the yoga grip blocks. FIG. 3 shows a top view in which the vertical dimension represents the width 6 and the horizontal dimension represents the length of the yoga grip blocks. It is preferred that the height of yoga grip blocks of the invention be not more than 5 inches from the block section top surfaces 3 to the block sections bottom surface 7. It is more preferred that the height of the yoga grip blocks be not more than 4 inches and most preferred that the height be not more than 3.5 inches.

In another aspect of the invention, the height of yoga grip blocks can be adjustable by means readily conceived and practiced by those skilled in the art. For example, block sections of yoga grip blocks can have a threaded recess in the base to receive a compatible threaded shaft attached to a bottom surface base plate. In such a case, the height of the yoga grip blocks could be adjusted by turning the base plate to "screw" it in or out. In another example, the block sections could comprise a stack of block segments which could be added or removed to adjust the height of the yoga grip blocks.

Surfaces and Materials

Another feature of the invention is frictional material on the block section bottom surfaces. Such a frictional surface can act to stabilize the blocks against movement from lateral forces encountered during yoga exercises. A frictional surface can be formed from any high friction material such as natural rubber, silicon polymers, neoprene foam or other materials known by those in the art. Preferred frictional materials are rugged for long usage but resilient to protect floor surfaces such as foam mats commonly used in yoga practice.

The block section top surfaces can also include frictional material in the invention. When yoga grip blocks are stacked one on the other, friction material on the top surface of the block sections will help prevent slippage and help maintain the stack against lateral forces. Since the block section top surface can be used for sitting or to support body weight on a practitioner's hands, preferred friction materials for the block section top surfaces of are relatively soft and resilient forms of natural rubber, silicon polymers, neoprene foam or other materials known by those in the art.

Another embodiment of the invention includes having a resilient surface on the grip section of the yoga grip blocks. To enhance the comfort of the hands, particularly when supporting body weight, the grip section can have a resilient surface to minimize the pressure experienced at the palm and fingers by the grip surface conforming somewhat at points of contact with the hand. The resilient surface can be made of fabric, leather, rubber, synthetic polymers, synthetic foam or other appropriate materials known in the art.

It is a preferred embodiment of the invention to have two or more yoga grip blocks. Many yoga positions require the practitioner to support the body on both hands and thus at least two yoga grip blocks can be useful. The two blocks, with their bottom surfaces on the floor, can be rotated about the vertical to allow independent gripping in any rotational orientation that suits a position or the practitioner's preference.

In addition, stacking two or more yoga grip blocks is an object of the invention. Stacking two or more yoga grip blocks allows the yoga practitioner to adjust the height of support to the level required for a particular position. As the practitioner gains experience or becomes more flexible in range of motion, yoga grip blocks can be added or removed to suit changing needs.

Yoga grip blocks of the invention can be fabricated from a wide range of suitable materials as may be readily determined by those skilled in the art. Yoga grip blocks can be carved from solid blocks of hard wood. Yoga grip blocks can be assembled by attaching a steel grip section to two wooden block sections. A preferred method of manufacture and preferred material for fabrication of yoga grip blocks is injection molding from plastic and/or plastic foam. Injection molded plastic yoga grip blocks can be produced at a low unit cost in a variety of smooth or custom contours to suit the needs and preferences of practitioners.

Using Yoga Grip Blocks

One aspect of the invention is methods to use yoga grip blocks in the practice of yoga exercises. The Yoga grip blocks of the invention are operatively positioned on the floor or a yoga matt. The top surfaces of the Yoga grip blocks support a yoga practitioner as described below or the practitioner can grip the yoga grip blocks as described below while practicing yoga positions.

A yoga practitioner can grip the grip section of yoga grip blocks by placing her palm on top of the grip section with her fingers wrapped around the grip section and with her wrist in a straight orientation. With such a grasp, the practitioner can support body weight with forces directed straight through the wrist to the palm; the fingers may be loosely dangled or may wrap abound the grip section. Such a grasp reduces stress on the wrist because it remains in a neutral position of it's range of motion and because the loose or curled finger positions reduce the tension of flexor tendons that traverse the wrist between flexor muscles of the forearm and the fingers.

Block sections, grip sections and transitional points of attachment between the grip and block sections, provide a variety of contours and surfaces for the yoga practitioner to grip while practicing yoga exercises. A position with the palm on top of the grip section and the fingers wrapped around the grip section can be the most comfortable and secure for yoga positions, e.g., the urdhva mukha svanasana (upward dog), where the arms support much of the body weight, or during dynamic transitions between positions. In other positions, e.g., the adho mukha svanasana (downward dog), where the arms are extended from the body and supporting less weight, the practitioner can support the weight with her palms on a block section and her fingers curled over the edge of the clock section. In still other positions, the practitioner can support weight with the palm on a block section, and the crook between the thumb and forefinger resting at a transitional point of attachment between the block section and grip section, while the fingers hang over the block section in a relaxed position.

Yoga grip blocks of this invention can also provide support to yoga practitioners. For example, while practicing the janu sirsasana (head-to-knee forward bend) the stress on the lower back can be minimized by sitting on yoga grip blocks. During, e.g., the pasasana position, tension can be removed from the foot arches and Achilles' tendon by supporting the heels with yoga grip blocks. Stacked yoga grip blocks can provide support for balance, e.g., while balancing all of a practitioner's weight on her arms in positions such as the bakasana (crane pose).

What is claimed is:

1. Yoga grip blocks for supporting a practitioner of yoga in a variety of yoga positions, said blocks comprising:

two or more stacked yoga grip blocks, each comprising:

two or more independent block sections separated by a hand grip section having a first end and a second end, with at least one of the block sections positioned at the first end of the hand grip section and with at least one of the block sections positioned at the second end, which grip section is narrower than at least one of the positioned block sections, the stacked blocks allowing the practitioner to support at least part of the practitioner's body weight during practice of the positions; and, the block sections each comprising unobstructed block section top surfaces.

2. The yoga grip blocks of claim 1, wherein the blocks are less than 5 inches in height and further comprise a top surface of the grip section common to the top surfaces of the block sections.

3. The yoga grip blocks of claim 1, wherein the blocks are less than 4 inches in height and further comprise a frictional block section top surface.

4. The yoga grip blocks of claim 1, wherein the blocks are less than 3.5 inches in height.

5. The yoga grip blocks of claim 1, wherein height of the one or more block sections is adjustable using a threaded shaft or removable block segments.

6. The yoga grip blocks of claim 1, wherein at least one of the stacked yoga grip blocks comprise: frictional block section bottom surfaces, flat top surface on the block sections, a height not more than a width, a frictional block section top surface or a top surface of the grip section common to the top surface of the block sections.

7. The yoga grip blocks of claim 1, further comprising a resilient grip section surface.

8. The yoga grip blocks of claim 1, wherein the block sections and grip section are formed from injection molded plastic.

9. A method of using yoga grip blocks comprising:

operatively positioning one or more yoga grip blocks of claim 1 on a flat surface, and practicing yoga positions with the support of the yoga grip blocks or while gripping the yoga grip blocks.

10. Yoga grip blocks for aiding a practitioner of yoga in a variety of yoga positions, said blocks comprising:

two or more independent block sections separated by a hand grip section having a first end and a second end, with at least one of the block sections positioned at the first end of the hand grip section and at least one of the block sections positioned at the second end, which grip section is narrower than at least one of the positioned block sections; and, the two or more block sections of the grip blocks comprising block section bottom surfaces and top surfaces;

wherein one or more of the bottom surfaces and one or more of the top surfaces each comprise a frictional surface;

the grip section and block sections allowing a choice of wrist, palm and finger orientations while the arms of the practitioner support the practitioner's body weight.

11. The yoga grip blocks of claim 10, wherein the grip section comprises a flat-topped grip section.

12. The yoga grip blocks of claim 10 comprising:

one or more block sections attached to a grip section comprising a resilient grip section surface; or, wherein the one or more block sections comprise unobstructed flat block section top surfaces.

* * * * *